US012007142B2

(12) United States Patent
Kim et al.

(10) Patent No.: US 12,007,142 B2
(45) Date of Patent: Jun. 11, 2024

(54) AIR CONDITIONER

(71) Applicant: LG ELECTRONICS INC., Seoul (KR)

(72) Inventors: Beomchan Kim, Seoul (KR); Jusu Kim, Seoul (KR); Eunseong Pack, Seoul (KR); Yeongpin Chu, Seoul (KR); Janghoon Shin, Seoul (KR); Jaeik Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 31 days.

(21) Appl. No.: 17/551,768

(22) Filed: Dec. 15, 2021

(65) Prior Publication Data

US 2022/0196264 A1 Jun. 23, 2022

(30) Foreign Application Priority Data

Dec. 17, 2020 (KR) ..... 10-2020-0177591

(51) Int. Cl.
*F24F 3/153* (2006.01)
*F24F 3/14* (2006.01)
(Continued)

(52) U.S. Cl.
CPC ..... *F24F 3/153* (2013.01); *F25B 40/02* (2013.01); *F25B 41/24* (2021.01); *F25B 41/40* (2021.01); *F24F 2003/144* (2013.01)

(58) Field of Classification Search
CPC ..... F24F 3/153; F25B 13/00; F25B 40/02; F25B 41/40; F25B 2400/13; F25B 2400/05; F25B 2400/054
See application file for complete search history.

(56) References Cited

U.S. PATENT DOCUMENTS 4,811,568 A * 3/1989 Horan ..... F25B 5/02 62/200
6,164,086 A * 12/2000 Kita ..... F25B 41/24 62/502
(Continued)

FOREIGN PATENT DOCUMENTS

KR 10-0564449 3/2006
KR 10-0710390 4/2007
(Continued)

OTHER PUBLICATIONS

Korean Notice of Allowance issued in Application No. 10-2020-0177591 dated Aug. 8, 2022.

*Primary Examiner* — Christopher R Zerphey
(74) *Attorney, Agent, or Firm* — KED & ASSOCIATES, LLP

(57) ABSTRACT

An air conditioner may include a case having a supply channel therein through which external air flows into an interior space; a first heat exchanger disposed on the supply channel and in which the air and refrigerant exchange heat; a second heat exchanger disposed at a downstream side of the first heat exchanger in the supply channel, and in which the air and refrigerant exchange heat; and a refrigerant distributor that sends refrigerant to the first heat exchanger or the second heat exchanger. The refrigerant distributor may include a liquid pipe connected with the first heat exchanger and through which liquid-state refrigerant flows; a first gas pipe connected to the first heat exchanger and the second heat exchanger and through which gas-state refrigerant flows; a second gas pipe through which gas-state refrigerant discharged from the first heat exchanger flows; a first gas pipe valve disposed on the first gas pipe and that sends refrigerant flowing through the first gas pipe to the first heat exchanger or the second heat exchanger; and a second
(Continued)

gas pipe valve disposed on the second gas pipe and that opens and closes the second gas pipe.

17 Claims, 8 Drawing Sheets

(51) Int. Cl.

| | |
|---|---|
| ***F25B 40/02*** | (2006.01) |
| ***F25B 41/24*** | (2021.01) |
| ***F25B 41/40*** | (2021.01) |

(56) References Cited

U.S. PATENT DOCUMENTS

| | | | | |
|---|---|---|---|---|
| 10,955,149 | B2 * | 3/2021 | Shi | F25B 6/04 |
| 11,614,242 | B2 * | 3/2023 | Jin | F25B 13/00 62/507 |
| 2009/0095005 | A1 * | 4/2009 | Dietrich | F25B 41/24 62/238.1 |

FOREIGN PATENT DOCUMENTS

| | | |
|---|---|---|
| KR | 20-2009-0006535 | 7/2009 |
| KR | 10-1782839 | 10/2017 |
| KR | 10-2019-0041092 | 4/2019 |
| WO | WO 2015/182463 | 12/2015 |

* cited by examiner

AIR CONDITIONER

CROSS-REFERENCE TO RELATED APPLICATION(S)

This application claims priority under 35 U.S.C. § 119 to Korean Application No. 10-2020-0177591, filed in Korea on Dec. 17, 2020, whose entire disclosure is hereby incorporated by reference.

BACKGROUND

1. Field

An air conditioner, and more particularly, an air conditioner including an indoor unit connected with an outdoor unit through a plurality of refrigerant pipes are disclosed herein.

2. Background

Ventilation equipment can adjust a temperature of air supplied to an interior space of a house or building, for example, through heat exchange between interior air that is discharged outside and external air that is supplied to the interior space, or can heat air flowing inside by being equipped with an additional heater. Accordingly, ventilation equipment can supply cooled and dehumidified air to the interior space by cooling and dehumidifying air flowing inside from the outside in a cooling mode.

A structure that reheats air flowing to the interior space using a separate heater has been disclosed in Korean Patent No. 10-1782839, which is hereby incorporated by reference. This structure has a problem that as it adjusts the temperature of flowing air using a heater that separately consumes power, power consumption increases, so that energy efficiency decreases.

BRIEF DESCRIPTION OF THE DRAWINGS

Embodiments will be described in detail with reference to the following drawings in which like reference numerals refer to like elements, and wherein.

DETAILED DESCRIPTION

Figure 1:
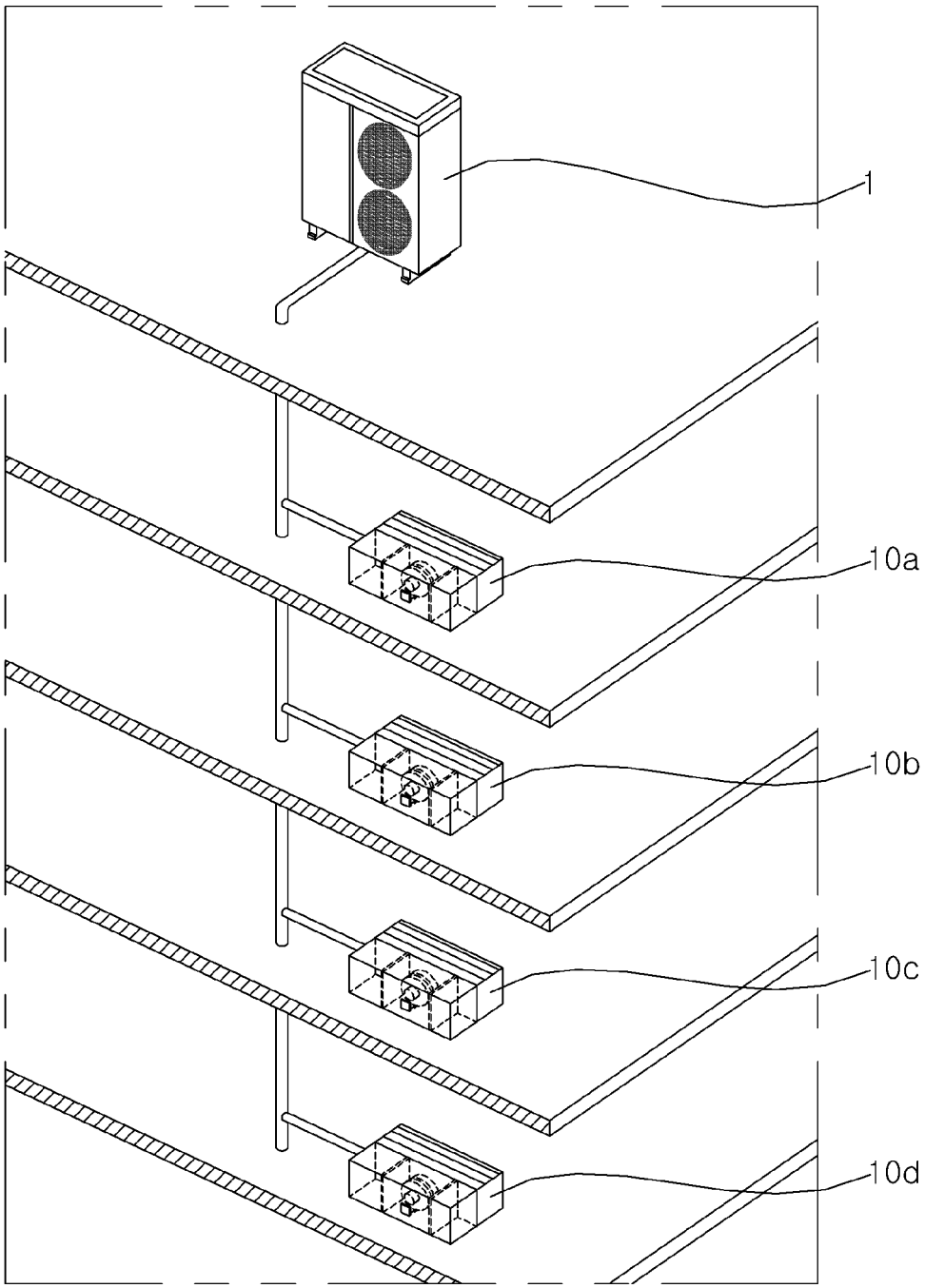
FIG. 1 is a view showing a state in which an outdoor unit and a plurality of indoor unit according to an embodiment are disposed at a building, for example.

Advantages and features of embodiments, and methods of achieving them will be clear by referring to the embodiments described hereinafter with reference to the accompanying drawings. However, the embodiments are not limited to the exemplary embodiments described hereinafter and may be implemented in various ways, and the exemplary embodiments are provided to complete the description and let those skilled in the art completely know the scope and embodiments are defined by claims. Like reference numerals indicate like components throughout the specification.

Hereinafter, embodiments will be described with reference to the drawings illustrating an air conditioner according to embodiments.

Referring to FIG. 1, an air conditioner according to embodiments may include an outdoor unit 1 disposed outside of a building, for example, and an indoor unit 10*a*, 10*b*, 10*c*, 10*d* disposed inside of the building, for example. The air conditioner according to embodiments may include at least one outdoor unit 1 and a plurality of indoor units 10*a*, 10*b*, 10*c*, and 10*d*.

The outdoor unit 1 and the indoor units 10*a*, 10*b*, 10*c*, and 10*d* may be connected through a plurality of refrigerant pipes. The outdoor unit 1 may be connected with the indoor units 10*a*, 10*b*, 10*c*, and 10*d* through three refrigerant pipes 30, 40, and 50 (see FIG. 4). Each indoor unit may be ventilation equipment that suctions external air, adjusts a temperature of the external air through a heat exchanger, and then supplies the external air to an interior space.

Hereafter, a configuration and channels in the indoor units 10 are described on the basis of one of the indoor units 10 with reference to FIGS. 2 to 7. Accordingly, referring to FIGS. 2 to 7, the indoor unit 10 to be described may be applied in the same way to the other indoor units.

Figure 2:
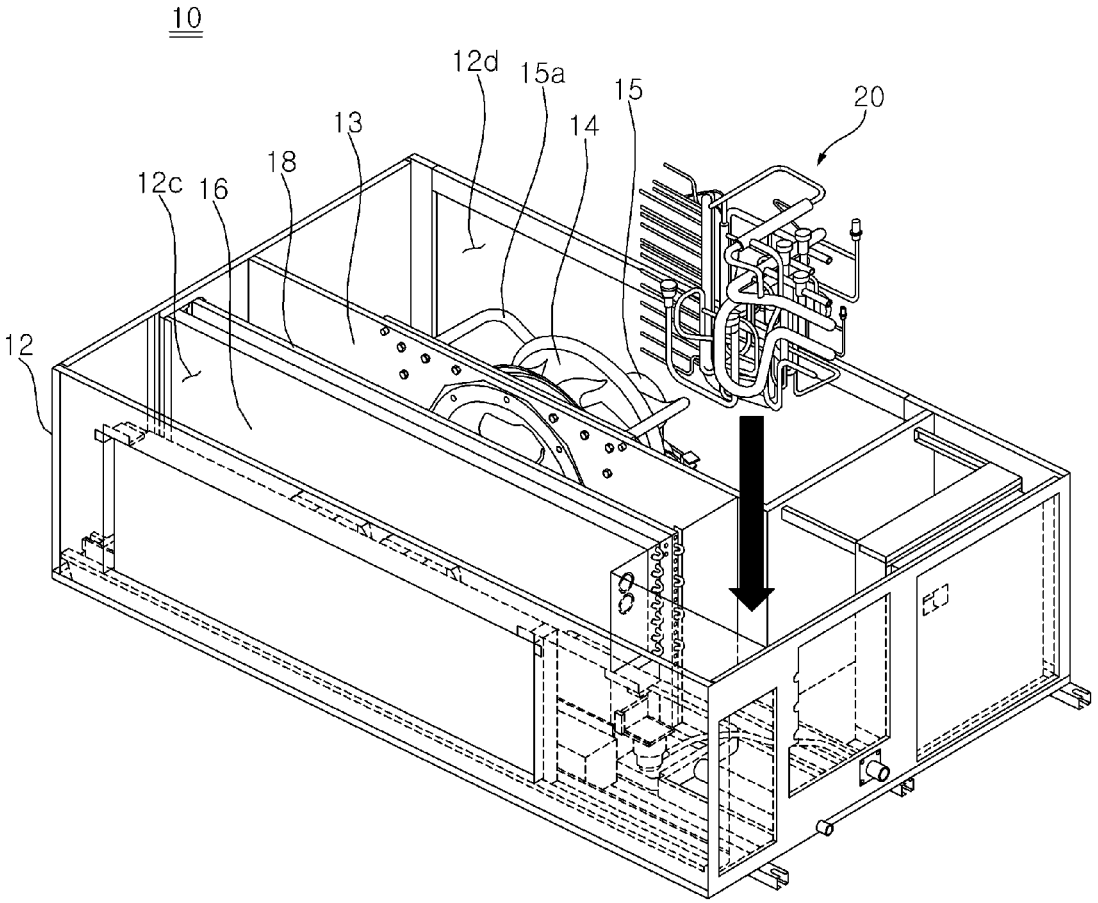
FIG. 2 is a view illustrating an internal configuration of an indoor unit according to an embodiment.
Figure 3:
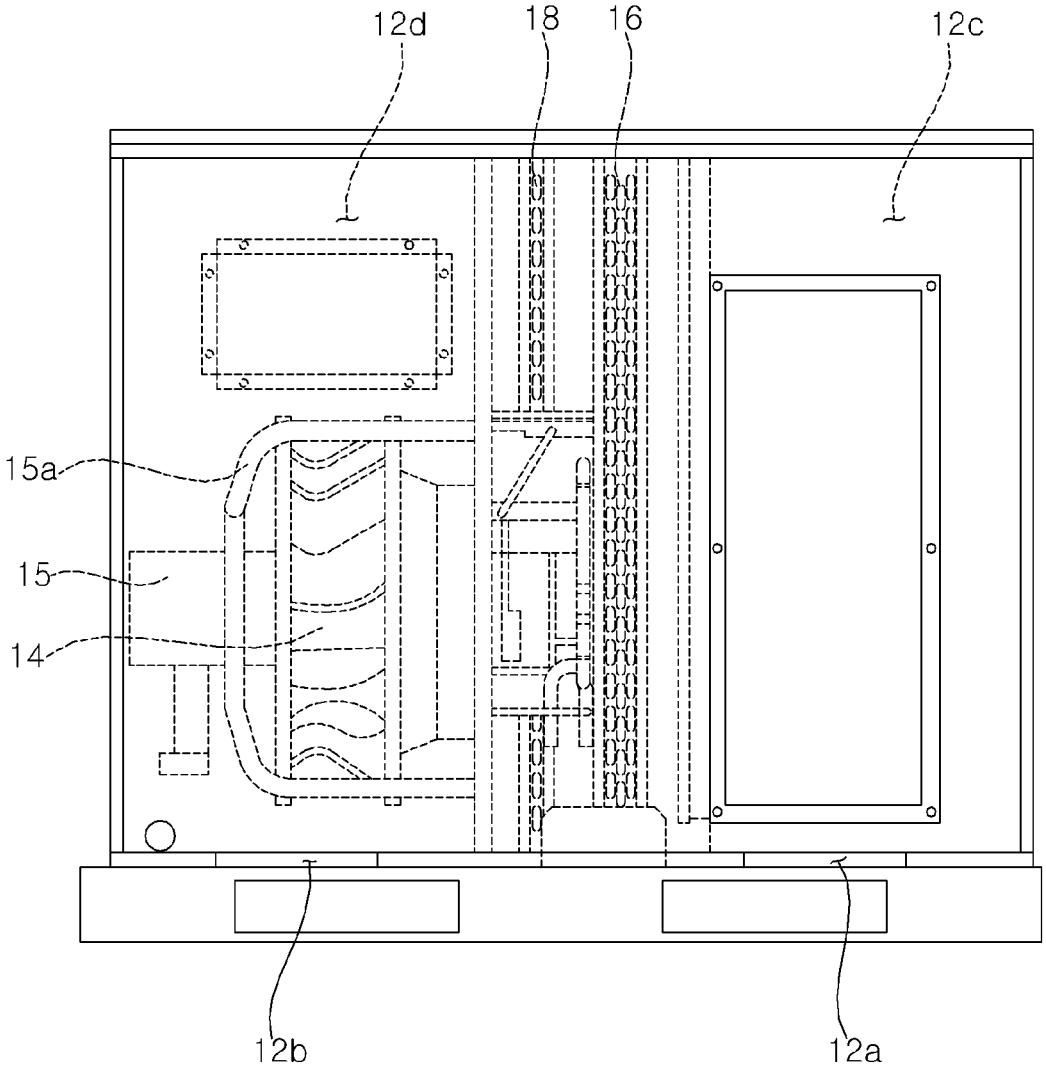
FIG. 3 is a side view illustrating the internal configuration of an indoor unit according to an embodiment.

Referring to FIG. 2, the indoor unit 10 may include a case 12 forming an external shape and forming a space therein in which air flows; a blowing fan 14 disposed in the case 12 and generating flow of air; a first heat exchanger 16 disposed in the space formed in the case 12 and performing heat exchange between refrigerant and air; a second heat exchanger 18 disposed in the space formed in the case 12 and performing heat exchange between refrigerant and air; and a refrigerant distributor 20 that sends the refrigerant flowing inside from the outdoor unit 1 to the first heat exchanger 16 or the second heat exchanger 18.

The case 12 has an inlet 12*a* and an outlet 12*b* on one side. The case 12 may include supply channels 12*c* and 12*d* therein through which external air flows in the space. The supply channels 12*c*, 12*d* may include discharge chamber 12*d* through which the air in the case 12 is discharged to the outside, and intake chamber 12*c* through which external air flows into the case 12.

A separation wall 13 that separates the intake chamber 12*c* and the discharge chamber 12*d* may be formed in the case 12. A through-hole may be formed at the separation wall 13 so that air in the intake chamber 12*c* may flow to the discharge chamber 12*d*.

The first heat exchanger 16 and the second heat exchanger 18 may be disposed in the supply channels 12*c*, 12*d*. The second heat exchanger 18 may be disposed at a downstream side in the supply channels 12*c*, 12*d* of the first heat exchanger 16.

The first heat exchanger 16 and the second heat exchanger 18 may be disposed in the intake chamber 12*c*. The first heat exchanger 16 and the second heat exchanger 18 may be disposed between the separation wall 13 and the inlet 12*a*.

The first heat exchanger 16 may be disposed adjacent to the inlet 12*a* and the second heat exchanger 18 may be disposed adjacent to the separation wall 13. Accordingly, air flowing in the intake chamber 12*c* through the inlet 12*a* may flow to the discharge chamber 12*d* through the first heat exchanger 16 and the second heat exchanger 18.

Figure 4:
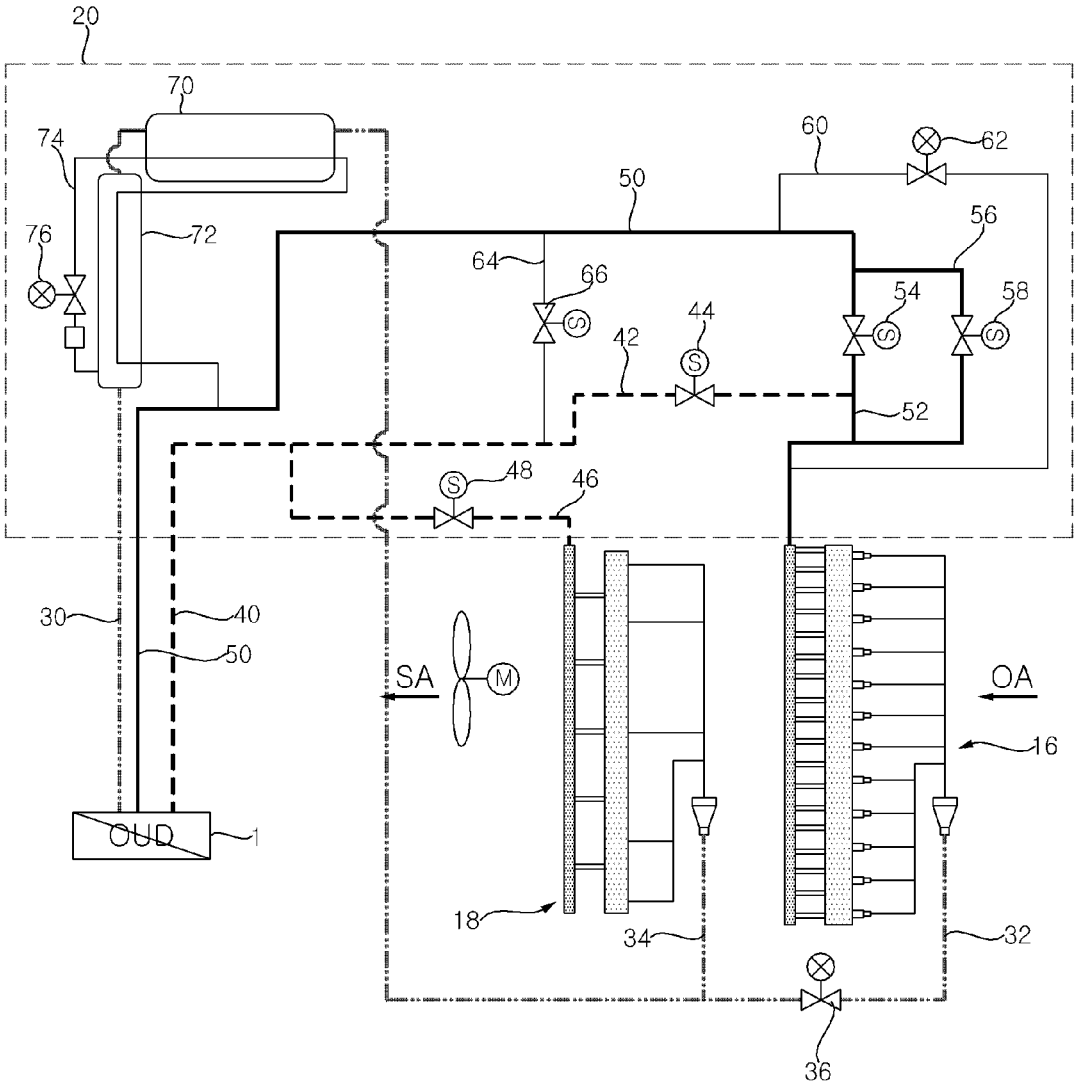
FIG. 4 is a schematic diagram illustrating flow of refrigerant in an indoor unit connected with an outdoor unit according to an embodiment.
Figure 5:
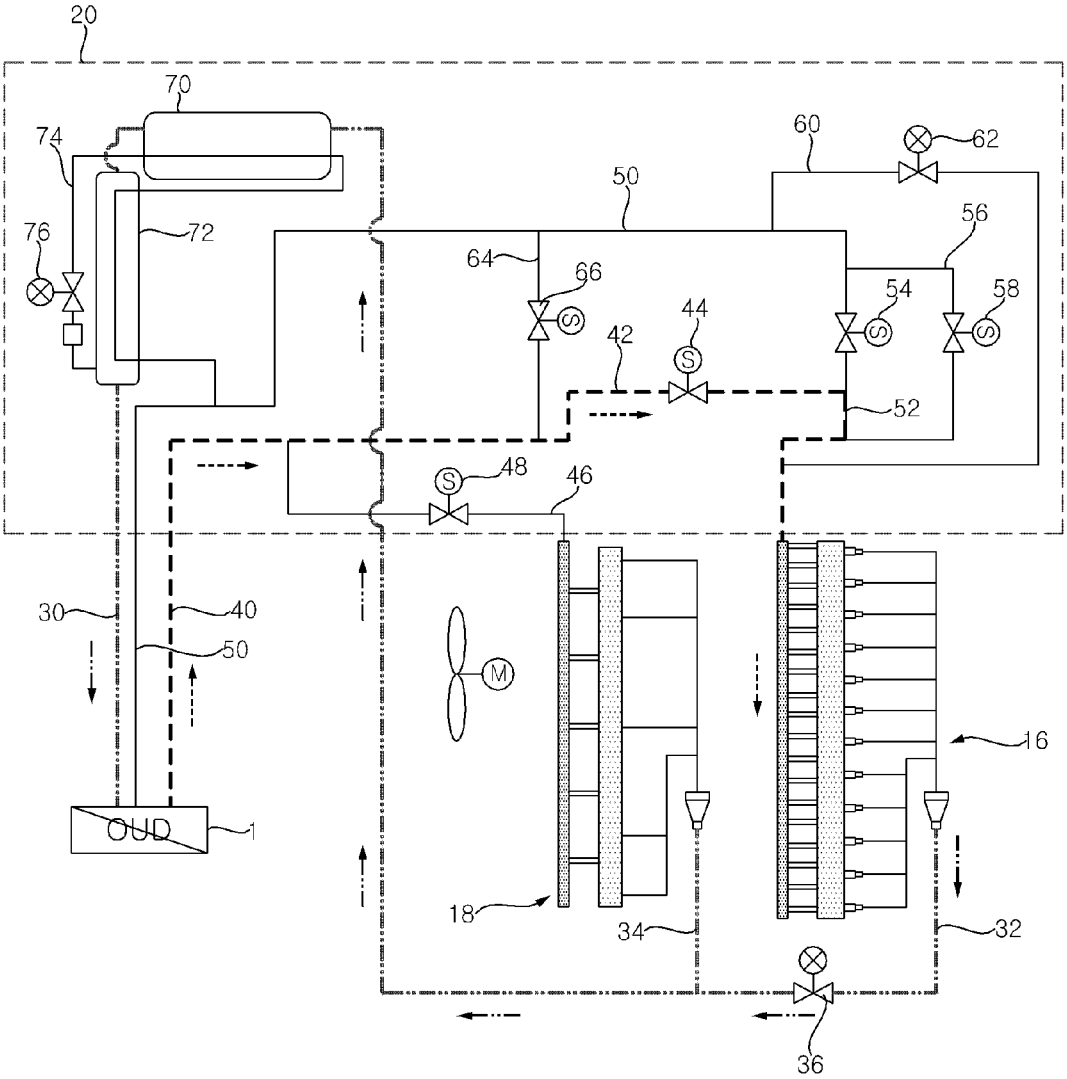
FIG. 5 is a schematic diagram illustrating a flow direction of refrigerant in an indoor unit according to an embodiment in an all heating mode and an individual heating mode.

Referring to FIG. 4, a flow rate of refrigerant flowing through the first heat exchanger 16 may be larger than a flow rate of the refrigerant flowing through the second heat exchanger 18. That is, a channel area of the first heat exchanger 16 may be larger than a channel area of the second heat exchanger 18.

Accordingly, a temperature of air may be changed more in the first heat exchanger 16 than the second heat exchanger 18. That is, referring to FIG. 7A, a cooling performance of the first heat exchanger 16 may be higher than a heating performance of the second heat exchanger 18, so air is cooled through the first heat exchanger 16 and dehumidified through the second heat exchanger 18, whereby cooled and dehumidified air may flow into the interior space.

The blowing fan 14 and a fan motor 15 that rotates the blowing fan 14 may be disposed in the discharge chamber 12*d*. The blowing fan 14 and a fan supporter 15*a* that supports the fan motor 15 may be disposed in the discharge chamber 12*d*. The blowing fan 14 may be a plug fan having an inlet formed in a direction of a rotary shaft and an outlet formed perpendicular to the rotary shaft.

The case 12 may form the space therein in which the refrigerant distributor 20 connected with the first heat exchanger 16 and the second 18 is disposed. A region in which the refrigerant distributor 20 is disposed may be disposed at a side of the intake chamber 12*c*.

The refrigerant distributor 20 may be disposed in the case 12 and connect the outdoor unit 1 to the first heat exchanger 16 and the second heat exchanger 18. The refrigerant distributor 20 may include the plurality of refrigerant pipes 30, 40, and 50 and a plurality of valves.

The refrigerant distributor 20 may include liquid pipe 30 that connects the outdoor unit 1 to the first heat exchanger 16 and the second heat exchanger 18 and through which liquid-state refrigerant flows; first gas pipe 40 that connects the outdoor unit 1 to the first heat exchanger 16 and the second heat exchanger 18 and through which gas-state refrigerant flows; and second gas pipe 50 that connects the outdoor unit 1 to the first heat exchanger 16. The refrigerant distributor 20 may further include first gas pipe valves 44 and 48 disposed on the first gas pipe 40 and that send the refrigerant flowing through the first gas pipe 40 to the first heat exchanger 16 or the second heat exchanger 18, and second gas pipe valves 54 and 58 disposed on the second gas pipe 50 and that open and close the second gas pipe 50.

Subcoolers 70 and 72 disposed in the liquid pipe 30 to expand and heat exchange with some or a first portion of the refrigerant flowing through the liquid pipe 30. Referring to FIG. 4, the subcoolers 70 and 72 may include first subcooler 70 and second subcooler 72 disposed at the upstream side of the first subcooler 70 on the liquid pipe 30.

The refrigerant diverging from the liquid pipe 30 and expanding flows through a divergence pipe 74. A channel is formed such that the refrigerant flowing through the divergence pipe 74 passes through a supercooling expansion valve 76 and then sequentially passes through the first supercooler 70 and the second supercooler 72. The divergence pipe 74 may form a channel such that the refrigerant that has passed through the second supercooler 72 flows to the second gas pipe 50.

That is, referring to FIG. 4, the first heat exchanger 16 may be disposed at the downstream side of the second heat exchanger 18 on the liquid pipe 30 through which refrigerant flows to the indoor unit 10 from the outdoor unit 1. The refrigerant diverging and flowing from the liquid pipe 30 flows to the second heat exchanger 18 through the first heat exchanger 16.

The first gas pipe 40 may be divided into a 1-1 gas pipe 42 connected with the first heat exchanger 16, and a 1-2 gas pipe 46 connected with the second heat exchanger 18. A 1-1 gas pipe valve 44 that opens and closes the 1-1 gas pipe 42 may be disposed on the 1-1 gas pipe 42. A 1-2 gas pipe valve 48 that opens and closes the 1-2 gas pipe 46 may be disposed on the 1-2 gas pipe 46.

The second gas pipe 50 may include a first parallel gas pipe 52 and a second parallel gas pipe 56. The first parallel gas pipe 52 and the second parallel gas pipe 56 may be divided in parallel and join each other inside of the refrigerant distributor 20. The refrigerant discharged from the first heat exchanger 16 is a low-pressure refrigerant and loses pressure. Accordingly, it is possible to reduce a pressure loss generated in the low-pressure refrigerant by dividing and joining flow of refrigerant through the two parallel gas pipes 52 and 56.

A first parallel gas pipe valve 54 that opens and closes the first parallel gas pipe 52 may be disposed on the first parallel gas pipe 52. A second parallel gas pipe valve 58 that opens and closes the second parallel gas pipe 52 may be disposed on the second parallel gas pipe 56.

The second gas pipe 50 may further include a pressure adjustment gas pipe 60 that diverges at the upstream side of the first parallel gas pipe 52 and the second parallel gas pipe 56 and converges at the downstream side of the first parallel gas pipe 52 and the second parallel gas pipe 56. A pressure adjustment gas pipe valve 62 that opens and closes the pressure adjustment gas pipe 60 may be disposed on the pressure adjustment gas pipe 60.

The refrigerant flowing through the first parallel gas pipe 52 and the second parallel gas pipe 56 may generate pressure in the first parallel gas pipe valve 54 and the second parallel gas pipe valve 58 when a compressor (not shown) is stopped. When the compressor is stopped and the flow of refrigerant is stopped, it is possible to balance the pressures at both ends of the second gas pipe 50 by closing the first parallel gas pipe 52 and the second parallel gas pipe 56 using the first parallel gas pipe valve 54 and the second parallel gas pipe valve 58 and by opening the pressure adjustment gas pipe 60 using the pressure adjustment gas pipe valve 62.

The refrigerant distributor 20 may include a connection gas pipe 64 that connects the first gas pipe 40 and the second gas pipe 50, and a connection gas pipe valve 66 that opens and closes the connection gas pipe 64. When liquid-state refrigerant is produced by condensing in the first gas pipe 40 through which high-pressure refrigerant flows, it is possible to send the condensate refrigerant to the second gas pipe 50 through which low-pressure refrigerant flows by opening the connection gas pipe 64 using the connection gas pipe valve 66.

Referring to FIG. 4, the connection gas pipe 64 connects the 1-1 gas pipe 42 and the second gas pipe 50. Referring again to FIG. 4, the first parallel gas pipe 52 may be connected with the 1-1 gas pipe 42.

Referring to FIG. 4, the liquid pipe 30 of the refrigerant pipe 20 may be divided into a first liquid pipe 32 and a second liquid pipe 34 and connected to the first heat exchanger 16 and the second heat exchanger 18. The first liquid pipe 32 may be connected with the first heat exchanger 16. An expansion valve 36 that expands the refrigerant flowing to the first heat exchanger 16 may be disposed on the first liquid pipe 32.

Hereinafter, flow of refrigerant according to modes of the air conditioner according to embodiments disclosed herein will be described with reference to FIGS. 5 to 7B.

According to the air conditioner according to embodiments disclosed herein, one outdoor unit 1 is connected to a plurality of indoor units 10. The air conditioner according to embodiments disclosed herein may be used in an all heating mode M1 in which all of the indoor units 10 are used for heating, an all cooling mode M2 in which all of the indoor units 10 are used for cooling, an individual heating mode M3 in which only some of the indoor units 10 are used for heating, and an individual cooling mode M4 in which only some of the indoor units 10 are used for cooling. The all heating mode M1 and the individual heating mode M3 are described with reference to FIG. 5. In the all heating mode M1 and the individual heating mode M3, only the liquid pipe 30 and the first gas pipe 40 are used and refrigerant may not flow to the second gas pipe 50. In the all heating mode M1 and the individual heating mode M3, refrigerant may flow through the same channel. In the all heating mode M1 and the individual heating mode M3, refrigerant may flow to the first heat exchanger 16 without flowing to the second heat exchanger 18.

In the all heating mode M1 and the individual heating mode M3, the refrigerant discharged from the compressor (not shown) flows to the first heat exchanger 16 through the first gas pipe 40. Accordingly, the 1-1 gas pipe valve 44 opens the 1-1 gas pipe 42 and the 1-2 gas pipe valve 48 closes the 1-2 gas pipe 46. Accordingly, the refrigerant flowing through the first gas pipe 40 flows to the first heat exchanger 16. The first heat exchanger 16 may be used as a condenser in which high-pressure gas-state refrigerant changes into liquid state through heat exchange.

The refrigerant discharged from the first heat exchanger 16 may flow to the outdoor unit 1 through the liquid pipe 30. The supercoolers 70 and 72 disposed on the liquid pipe 30 may not be separately operated.

Figure 6:
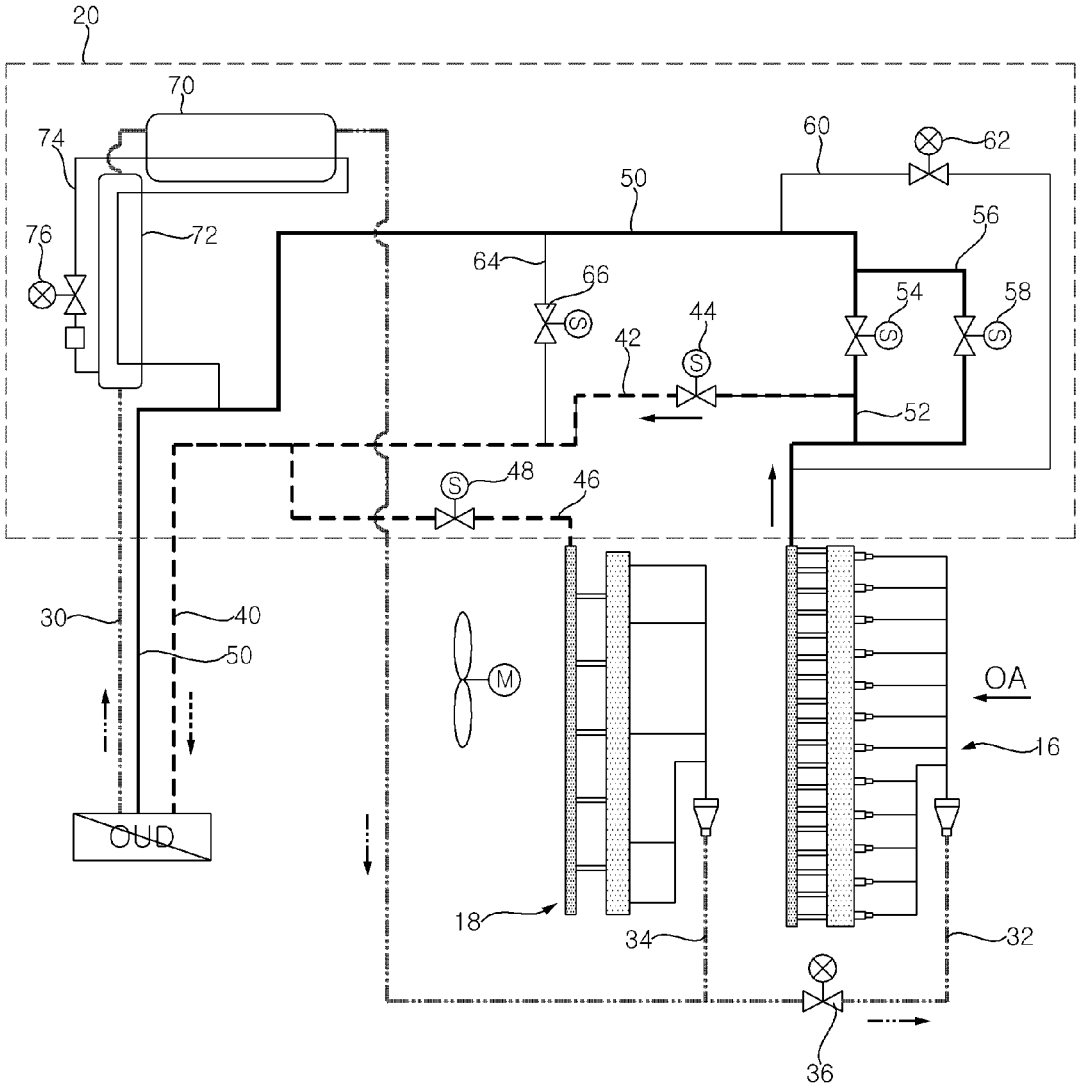
FIG. 6 is a schematic diagram illustrating a flow direction of refrigerant in an indoor unit according to an embodiment in the all heating mode.

The all cooling mode M2 is described with reference to FIG. 6. In the all cooling mode M2, only the liquid pipe 30 and the first gas pipe 40 are used and refrigerant may not flow to the second gas pipe 50. In the all cooling mode M2, refrigerant may flow through the same channel. In the all cooling mode M2, refrigerant may flow to the first heat exchanger 16 without flowing to the second heat exchanger 18.

In the all cooling mode M2, the refrigerant discharged from the compressor flows to the first heat exchanger 16 through an outdoor heat exchanger (not shown) and the liquid pipe 30. The refrigerant flowing through the liquid pipe 30 flows to the first liquid pipe 32 and flows to the first heat exchanger 16 through the expansion valve 36. In this case, as the 1-1 gas pipe valve 48 closes the 1-2 gas pipe 46, refrigerant does not flow to the second liquid pipe 34. The first heat exchanger 16 may be used as an evaporator that changes the phase of liquid-state refrigerant into gas-state refrigerant. The refrigerant discharged from the first heat exchanger 16 may flow to the first gas pipe 40 through the 1-1 gas pipe 42 and flows to the outdoor unit 1.

Figure 7A:
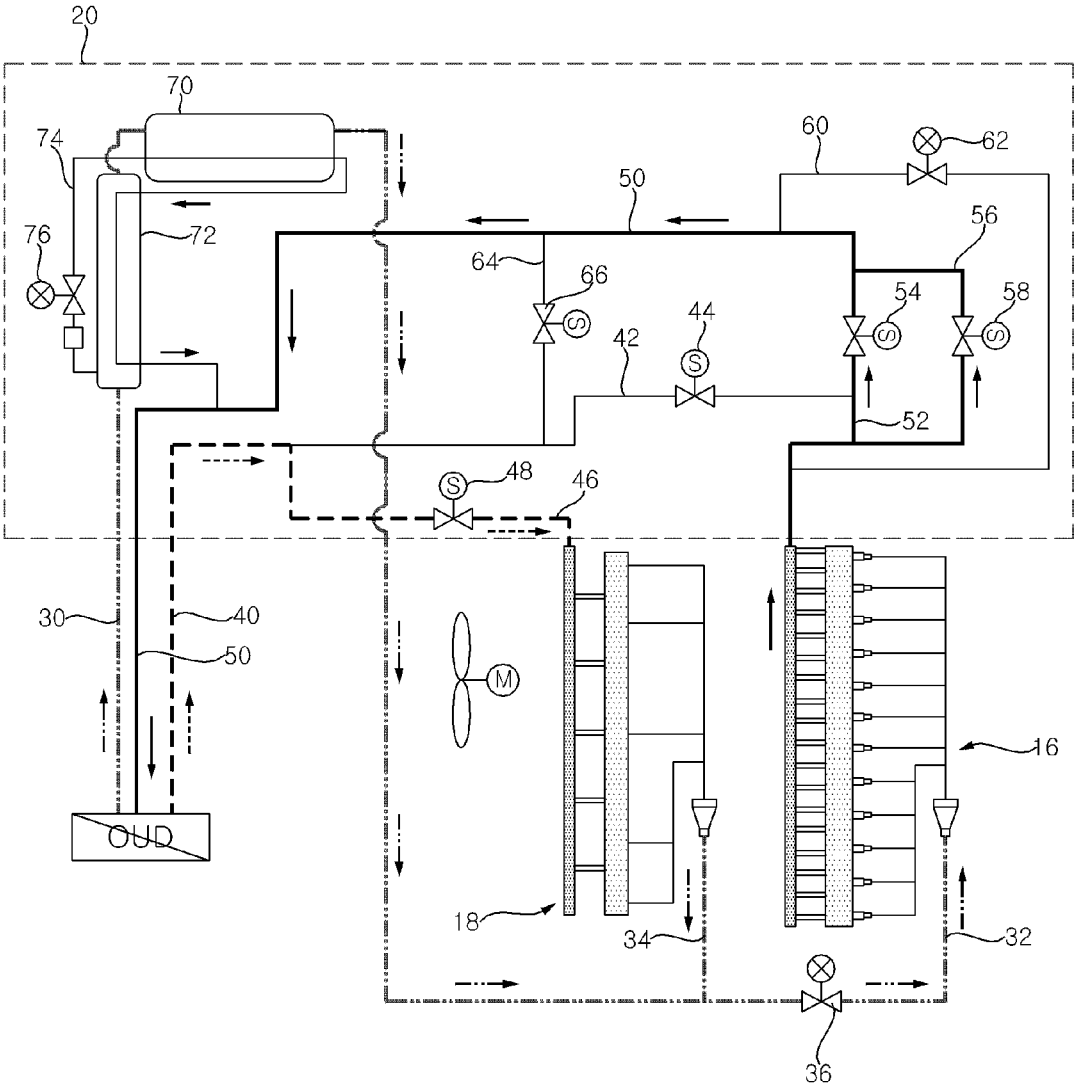
FIG. 7A is a schematic diagram illustrating a flow direction of refrigerant in an indoor unit according to an embodiment in the individual heating mode.
Figure 7B:
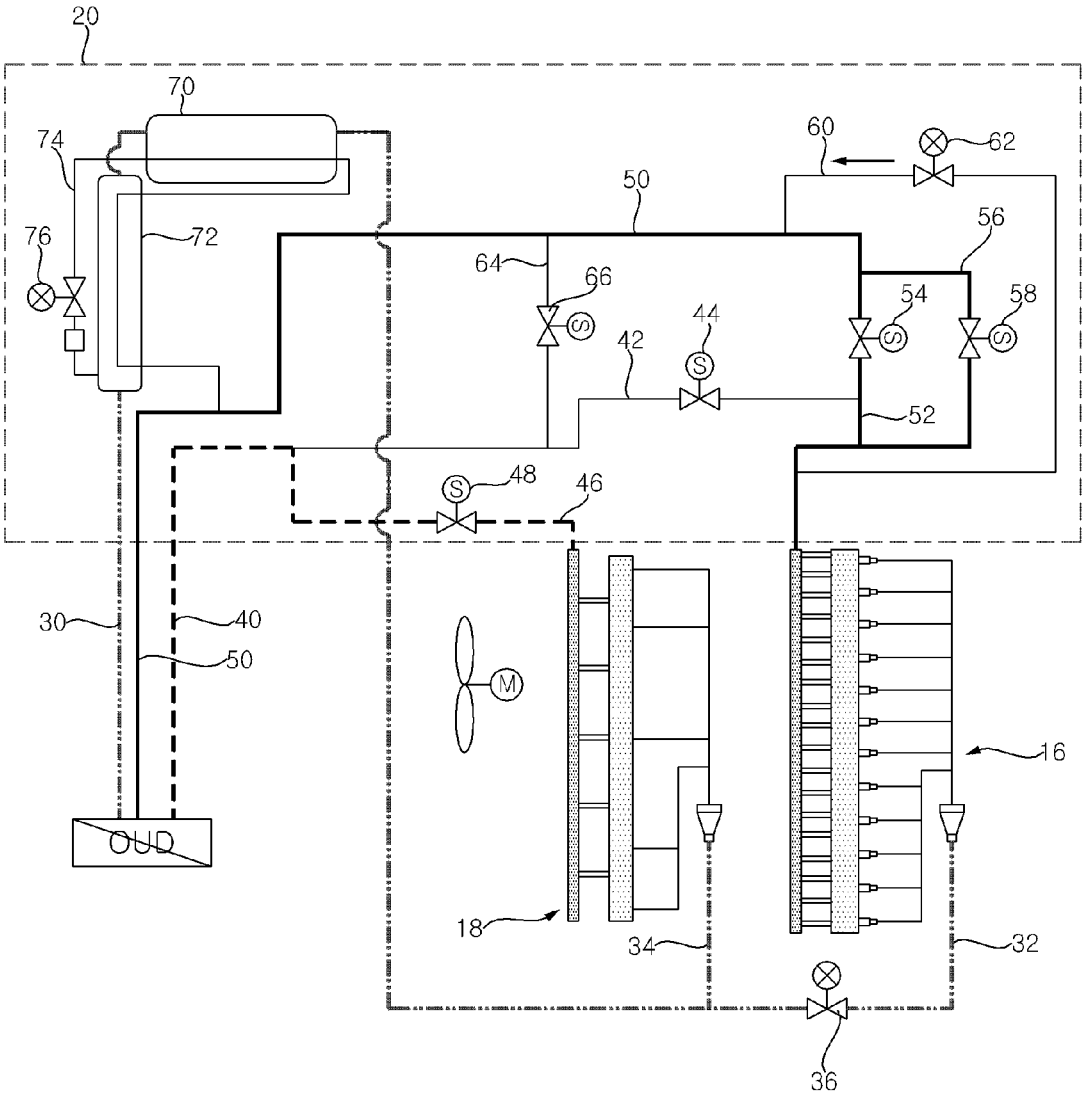
FIG. 7B is a schematic diagram illustrating a flow direction of refrigerant in an indoor unit according to an embodiment in a state in which the individual heating mode is finished.

The individual cooling mode M4 is described with reference to FIGS. 7A and 7B. In the individual cooling mode M4, refrigerant flows to the liquid pipe 30, the first gas pipe 40, and the second gas pipe 50. Refrigerant flows into the indoor unit 10 from the outdoor unit 1 through the liquid pipe 30 and the first gas pipe 40, and the refrigerant in the indoor unit 10 flows to the outdoor unit 1 through the second gas pipe 50.

The 1-1 gas pipe valve 44 closes the 1-1 gas pipe 42 and the 1-2 gas pipe valve 48 opens the 1-2 gas pipe 46. Accordingly, high-pressure refrigerant flowing through the first gas pipe 40 flows to the second heat exchanger 18. The second heat exchanger 18 may be used as a condenser, thereby being able to heat flowing air.

The refrigerant discharged from the second heat exchanger 18 flows to the first heat exchanger 16 through the second liquid pipe 34 and the first liquid pipe 32. The refrigerant flowing through the liquid pipe 30 flows through the first liquid pipe 32 and flows to the first heat exchanger 16. Some of the refrigerant flowing through the liquid pipe 30 flows through the divergence pipe 74 and passes through the supercooling expansion valve 76, and then sequentially passes through the first supercooler 70 and the second supercooler 72, whereby the refrigerant flowing through the liquid pipe 30 may be supercooled. The refrigerant flowing through the divergence pipe 74 flows to the outdoor unit 1 through the second gas pipe 50.

The first heat exchanger 16 may be used as an evaporator. Accordingly, air cooled and decreased in humidity through the first heat exchanger 16 may be partially heated through the second heat exchanger 18, whereby the air may flow into the interior space with the relative humidity decreased. Accordingly, the air that has passed through the first heat exchanger 16 and the second heat exchanger 18 may flow into the interior space in a cooled and dehumidified state.

The refrigerant flowing from the first heat exchanger 16 flows through the second gas pipe 50. Referring to FIG. 7A, when the compressor is operated, the first parallel gas pipe valve 54 and the second parallel gas pipe valve 58 open the first parallel gas pipe 52 and the second parallel gas pipe 56 and the pressure adjustment gas pipe valve 62 closes the pressure adjustment gas pipe 60. Accordingly, the refrigerant flowing from the first heat exchanger 16 flows through the first parallel gas pipe 52 and the second parallel gas pipe 56. The refrigerant discharged from the first heat exchanger 16 is a low-pressure refrigerant, and when the refrigerant flows through one gas pipe, a large amount of pressure of the gas-state refrigerant may be lost. In embodiments disclosed herein, it is possible to reduce a pressure loss of the refrigerant flowing from the first heat exchanger 16 by dividing the second gas pipe 50 into the first parallel gas pipe 52 and the second parallel gas pipe 56 and then joining them.

The refrigerant flowing through the second gas pipe 50 may flow to the compressor of the outdoor unit 1. However, when operation of the compressor is stopped, as in FIG. 7B, the first parallel gas pipe valve 54 and the second parallel gas pipe valve 58 close the first parallel gas pipe 52 and the second parallel gas pipe 56 and the pressure adjustment gas pipe valve 62 opens the pressure adjustment gas pipe 60.

When the compressor is stopped and the first parallel gas pipe valve 54 and the second parallel gas pipe valve 58 close the first parallel gas pipe 52 and the second parallel gas pipe 56, pressure may be generated in the first parallel gas pipe valve 54 and the second parallel gas pipe valve 58. In this case, when the pressure adjustment gas pipe 60 is opened by the pressure adjustment gas pipe valve 62, the pressures at both ends of the second gas pipe 50 may be balanced.

Embodiments disclosed herein provide an air conditioner that can adjust temperature and humidity of air, which is supplied to an interior space, through a plurality of heat exchangers. Embodiments disclosed herein further provide an air conditioner that minimizes power consumption of an indoor unit through a structure that adjusts a refrigerant that is supplied to heat exchangers. Embodiments disclosed herein furthermore provide an air conditioner that minimizes a loss of pressure according to flow of a refrigerant. Embodiments disclosed herein also provide an air conditioner that maximizes performance of an evaporator.

Advantages of embodiments disclosed herein are not limited to the advantages described above and other advantages will be clearly understood by those skilled in the art from the description.

Embodiments disclosed herein provide an air conditioner that may include a case having a supply channel therein through which external air flows into an interior space; a first heat exchanger disposed in the supply channel and in which flowing air and refrigerant exchange heat; a second heat exchanger disposed at a downstream side of the first heat exchanger in the supply channel, and in which flowing air and refrigerant exchange heat; and a refrigerant distributor that sends refrigerant to the first heat exchanger or the second heat exchanger, whereby flow of refrigerant may be generated to a plurality of heat exchangers disposed in an indoor unit. The refrigerant distributor may include a liquid pipe connected with the first heat exchanger and through which liquid-state refrigerant flows; a first gas pipe connected to the first heat exchanger and the second heat exchanger and through which gas-state refrigerant flows; a second gas pipe through which gas-state refrigerant discharged from the first heat exchanger flows; a first gas pipe valve disposed on the first gas pipe and that sends refrigerant flowing through the first gas pipe to the first heat exchanger or the second heat exchanger, and a second gas pipe valve disposed on the second gas pipe and that opens and closes the second gas pipe, thereby being able to supply refrigerant to the first heat exchanger or the second heat exchanger. Accordingly, it is possible to adjust a temperature and humidity of the air flowing to the interior space by individually or simultaneously using the heat exchangers as evaporators or condensers.

The first gas pipe may be divided into a 1-1 gas pipe connected to the first heat exchanger and a 1-2 gas pipe connected to the second heat exchanger. The first gas pipe valve may include a 1-1 valve disposed on the 1-1 gas pipe and that opens and closes the 1-1 gas pipe, and a 1-2 valve disposed on the 1-2 gas pipe and that opens and closes the 1-2 gas pipe. The 1-1 valve may close the 1-1 gas pipe when refrigerant flows to the second gas pipe, whereby it is possible to use the first heat exchanger as an evaporator and the second heat exchanger as a condenser. Accordingly, it is possible to cool and dehumidify the air flowing to the interior space.

The second gas pipe may include a first parallel gas pipe and a second parallel gas pipe that are divided and joined in the refrigerant distributor. The second gas pipe valve may include a first parallel gas pipe valve that opens and closes the first parallel gas pipe, and a second parallel gas pipe valve that opens and closes the second parallel gas pipe, whereby it is possible to minimize a pressure loss of the low-pressure refrigerant discharged from the first heat exchanger.

The second gas pipe may further include a pressure adjustment gas pipe that diverges at an upstream side of the first parallel gas pipe and the second parallel gas pipe and converges at a downstream side of the first parallel gas pipe and the second parallel gas pipe, whereby it is possible to adjust a pressure difference at both ends of the second gas pipe when the operation of a compressor is stopped. A pressure adjustment gas pipe valve that opens and closes an internal channel of the pressure adjustment gas pipe is disposed on the pressure adjustment gas pipe, and the first parallel gas pipe valve and the second parallel gas pipe valve close the first parallel gas pipe valve and the second parallel gas pipe and the pressure adjustment gas pipe valve opens the pressure adjustment gas pipe when flow of refrigerant is stopped, whereby it is possible to adjust a pressure difference at both ends of the second gas pipe when operation of the compressor is stopped.

The first heat exchanger has a larger channel area than the second heat exchanger, whereby air that sequentially passes through the first heat exchanger and the second heat exchanger may flow to the interior space in a cooled and dehumidified state.

The air conditioner may further include a connection gas pipe that connects the first gas pipe and the second gas pipe, and a connection gas pipe valve that opens and closes the connection gas pipe, whereby it is possible to condense high-pressure refrigerant generated in the first gas pipe.

A supercooler that supercools refrigerant flowing through the liquid pipe by expanding and generating heat exchange with some of refrigerant flowing through the liquid pipe may be disposed on the liquid pipe, whereby it is possible to increase efficiency of the first heat exchanger. The supercooler may include a first supercooler, and a second super cooler disposed at an upstream side of the first supercooler on the liquid pipe. Refrigerant diverging from the liquid pipe may sequentially flow through the first supercooler and the second supercooler, whereby performance of the supercooler may be improved.

The air conditioner may further include a divergence pipe that diverges from the liquid pipe and connected to the supercooler, in which refrigerant flowing through the divergence pipe passes through the supercooler via a supercooling expansion valve and then flows to the second gas pipe, whereby gas-state liquid exchanging heat through the supercooler may flow to the compressor.

When the first heat exchanger heats air flowing through the supply channel, the refrigerant distributor stops supplying refrigerant to the second heat exchanger, whereby only the first heat exchanger may be used in a heating mode.

An air conditioner according to embodiments disclosed herein may include an outdoor unit that includes a compressor that compresses refrigerant and an outdoor unit in which refrigerant and external air exchange heat, and a plurality of indoor units connected with the outdoor unit through a plurality of refrigerant pipes and that adjusts a temperature of air flowing to an interior space. The plurality of indoor units may each include a case having a supply channel therein through which external air flows into an interior space; a first heat exchanger disposed in the supply channel and in which flowing air and refrigerant exchange heat; a second heat exchanger disposed at a downstream side of the first heat exchanger in the supply channel, and in which flowing air and refrigerant exchange heat; and a refrigerant distributor connected with the refrigerant pipes and that sends refrigerant flowing inside from the outdoor unit to the first heat exchanger or the second heat exchanger, whereby it is possible to supply air to the interior space through the heat exchangers individually from the indoor units.

According to the air conditioner of embodiments disclosed herein, at least one or more advantages may be achieved as follows.

First, as a plurality of heat exchanger and a refrigerant distributor adjusting a supply of refrigerant to the heat exchangers are included in an indoor unit, it is possible to adjust a temperature and humidity of the air that is supplied to an interior space without separately consuming power. Accordingly, there is an advantage that power consumption is minimized, so pleasant air may be provided to users.

Second, flow of refrigerant may be discharged from a first heat exchanger through a channel having two parallel structures, so there is an advantage that it is possible to minimize a pressure loss of a low-pressure refrigerant discharged from the heat exchanger.

Third, refrigerant flowing through a liquid pipe may flow sequentially through two supercoolers, so there is an advantage that it is possible to maximize performance of the first heat exchanger.

Advantages are not limited to those described above and other advantages not stated herein may be made apparent to those skilled in the art from claims.

Although embodiments were illustrated and described above, the embodiments are not limited to the specific exemplary embodiments and may be modified in various ways by those skilled in the art without departing from the scope described in claims, and the modified examples should not be construed independently from the spirit of the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a case having a supply channel therein through which external air flows into an interior space;

a first heat exchanger disposed in the supply channel and in which the air and refrigerant exchange heat;

a second heat exchanger disposed at a downstream side of the first heat exchanger in the supply channel, and in which the air and refrigerant exchange heat; and a refrigerant distributor that sends refrigerant to the first heat exchanger or the second heat exchanger, wherein the refrigerant distributor includes:

a liquid pipe through which liquid-state refrigerant flows, wherein the liquid pipe is connected to a first side of each of the first heat exchanger and the second heat exchanger;

a first gas pipe through which gas-state refrigerant discharged from the compressor flows, wherein the first gas pipe is connected to a second side of each of the first heat exchanger and the second heat exchanger;

a second gas pipe through which gas-state refrigerant flowing into a compressor flows, wherein the second gas pipe is connected to the second side of the first heat exchanger;

a first gas pipe valve disposed on the first gas pipe and that sends refrigerant flowing through the first gas pipe to the first heat exchanger or the second heat exchanger; and a second gas pipe valve disposed on the second gas pipe and that opens and closes the second gas pipe, wherein the first gas pipe is divided into a 1-1 gas pipe connected to the first heat exchanger and a 1-2 gas pipe connected to the second heat exchanger, wherein the first gas pipe valve includes a 1-1 valve disposed on the 1-1 gas pipe and that opens and closes the 1-1 gas pipe, and a 1-2 valve disposed on the 1-2 gas pipe and that opens and closes the 1-2 gas pipe, wherein the second gas pipe includes a first parallel gas pipe and a second parallel gas pipe that are divided and joined in the refrigerant distributor, wherein the second gas pipe valve includes a first parallel gas pipe valve that opens and closes the first parallel gas pipe and a second parallel gas pipe valve that opens and closes the second parallel gas pipe, wherein the 1-1 gas pipe is connected to the first parallel gas pipe, and wherein the 1-1 gas pipe is connected to the first heat exchanger through the second gas pipe.

2. The air conditioner of claim 1, wherein the 1-1 valve closes the 1-1 gas pipe when refrigerant flows to the second gas pipe.

3. The air conditioner of claim 1, wherein the second gas pipe further includes a pressure adjustment gas pipe that diverges at an upstream side of the first parallel gas pipe and the second parallel gas pipe and converges at a downstream side of the first parallel gas pipe and the second parallel gas pipe.

4. The air conditioner of claim 3, wherein a pressure adjustment gas pipe valve that opens and closes an internal channel of the pressure adjustment gas pipe is disposed on the pressure adjustment gas pipe, and wherein the first parallel gas pipe valve and the second parallel gas pipe valve close the first parallel gas pipe valve and the second parallel gas pipe, and the pressure adjustment gas pipe valve opens the pressure adjustment gas pipe when flow of refrigerant is stopped.

5. The air conditioner of claim 1, wherein the first heat exchanger and the second heat exchanger are configured such that a flow rate of the refrigerant flowing through the first heat exchanger is larger than a flow rate of the refrigerant flowing through the second heat exchanger.

6. The air conditioner of claim 1, further comprising:

a connection gas pipe that connects the first gas pipe and the second gas pipe; and a connection gas pipe valve that opens and closes the connection gas pipe.

7. The air conditioner of claim 1, wherein a subcooler disposed in the liquid pipe to expand and heat exchange with a first portion of refrigerant flowing through the liquid pipe is disposed on the liquid pipe.

8. The air conditioner of claim 7, wherein the subcooler includes a first subcooler, and a second subcooler disposed at an upstream side of the first subcooler on the liquid pipe, and wherein refrigerant diverging from the liquid pipe sequentially flows through the first subcooler and the second subcooler.

9. The air conditioner of claim 7, further comprising a divergence pipe that diverges from the liquid pipe and connected to the subcooler, wherein refrigerant flowing through the divergence pipe passes through the subcooler via a subcooling expansion valve and then flows to the second gas pipe.

10. The air conditioner of claim 1, wherein when the first heat exchanger heats air flowing through the supply channel, the refrigerant distributor is configured to stop supplying refrigerant to the second heat exchanger.

11. An air conditioner, comprising:

an outdoor unit that includes a compressor that compresses refrigerant and an outdoor heat exchanger in which refrigerant and external air exchange heat; and a plurality of indoor units connected with the outdoor unit through a plurality of refrigerant pipes and that adjusts a temperature of the air flowing into an interior space, wherein the plurality of indoor units each includes:

a case having a supply channel therein through which external air flows into the interior space;

a first heat exchanger disposed in the supply channel and in which the air and refrigerant exchange heat;

a second heat exchanger disposed at a downstream side of the first heat exchanger in the supply channel, and in which the air and refrigerant exchange heat; and a refrigerant distributor connected with the plurality of refrigerant pipes and that sends refrigerant flowing from the outdoor unit to the first heat exchanger or the second heat exchanger, wherein the refrigerant distributor includes:

a liquid pipe through which liquid-state refrigerant flows, wherein the liquid pipe is connected to a first side of each of the first heat exchanger and the second heat exchanger;

a first gas pipe through which gas-state refrigerant discharged from the compressor flows, wherein the first gas pipe is connected to a second side of each of the first heat exchanger or the second heat exchanger;

a second gas pipe through which gas-state refrigerant flowing into the compressor flows, wherein the second gas pipe is connected to the second side of the first heat exchanger;

a first gas pipe valve disposed on the first gas pipe and that sends refrigerant flowing through the first gas pipe to the first heat exchanger or the second heat exchange; and a second gas pipe valve disposed on the second gas pipe and that opens and closes the second gas pipe, wherein the first gas pipe is divided into a 1-1 gas pipe connected to the first heat exchanger and a 1-2 gas pipe connected to the second heat exchanger; wherein the first gas pipe valve includes a 1-1 valve disposed on the 1-1 gas pipe and that opens and closes the 1-1 gas pipe, and a 1-2 valve disposed on the 1-2 gas pipe and that opens and closes the 1-2 gas pipe, wherein the second gas pipe includes a first parallel gas pipe and a second parallel gas pipe that are divided and joined in the refrigerant distributor, wherein the second gas pipe valve includes a first parallel gas pipe valve that opens and closes the first parallel gas pipe and a second parallel gas pipe valve that opens and closes the second parallel gas pipe, wherein the 1-1 gas pipe is connected to the first parallel gas pipe, and wherein the 1-1 gas pipe is connected to the first heat exchanger through the second gas pipe.

12. The air conditioner of claim 11, wherein the 1-1 valve closes the 1-1 gas pipe when refrigerant flows to the second gas pipe.

13. The air conditioner of claim 11, wherein the second gas pipe further includes a pressure adjustment gas pipe that diverges at an upstream side of the first parallel gas pipe and the second parallel gas pipe and converges at a downstream side of the first parallel gas pipe and the second parallel gas pipe.

14. The air conditioner of claim 13, wherein a pressure adjustment gas pipe valve that opens and closes an internal channel of the pressure adjustment gas pipe is disposed on the pressure adjustment gas pipe, and wherein the first parallel gas pipe valve and the second parallel gas pipe valve close the first parallel gas pipe valve and the second parallel gas pipe, and the pressure adjustment gas pipe valve opens the pressure adjustment gas pipe when flow of refrigerant is stopped.

15. The air conditioner of claim 11, wherein the first heat exchanger and the second heat exchanger are configured such that a flow rate of the refrigerant flowing through the first heat exchanger is larger than a flow rate of the refrigerant flowing through the second heat exchanger.

16. The air conditioner of claim 11, further comprising:

a connection gas pipe that connects the first gas pipe and the second gas pipe; and a connection gas pipe valve that opens and closes the connection gas pipe.

17. The air conditioner of claim 11, wherein a subcooler is disposed in the liquid pipe to expand and generate heat exchange with a first portion of refrigerant flowing through the liquid pipe.

* * * * *